US006948430B1

(12) United States Patent
Montbleau et al.

(10) Patent No.: US 6,948,430 B1
(45) Date of Patent: Sep. 27, 2005

(54) PRINTING PLATE CONVEYOR SYSTEM

(75) Inventors: Robert Montbleau, Dracut, MA (US); John Wolber, Nashua, NH (US); Joseph German, Salem, NH (US); Mark Faynzilberg, Swampscott, MA (US)

(73) Assignee: Agfa Corporation, Wilmington, MA (US)

( * ) Notice: Subject to any disclaimer, the term of this patent is extended or adjusted under 35 U.S.C. 154(b) by 0 days.

(21) Appl. No.: 10/806,897

(22) Filed: Mar. 23, 2004

(51) Int. Cl.[7] ..... B41F 21/00; B65H 5/10

(52) U.S. Cl. ..... 101/477; 271/11; 271/264; 271/194; 198/721; 198/750.12

(58) Field of Search ..... 101/477, 483; 271/10.01, 11, 90, 99, 264, 194, 196, 267; 198/717, 721, 736, 738, 747, 750.1, 750.11, 198/750.12

(56) References Cited

U.S. PATENT DOCUMENTS 5,526,747 A * 6/1996 Marmin et al. ..... 101/477
6,718,875 B2 * 4/2004 Ono ..... 101/477
6,792,861 B2 * 9/2004 Kan et al. ..... 101/477

FOREIGN PATENT DOCUMENTS

WO WO 00/49463 8/2000

* cited by examiner

*Primary Examiner*—Leslie J. Evanisko
(74) *Attorney, Agent, or Firm*—Grant Houston; Robert A. Sabourin

(57) ABSTRACT

A conveyor system for transporting a printing plate in a platemaking system includes: a carriage riding on a track and one or more low friction substantially horizontal planar support surfaces provided as a high wear laminate, positioned above the carriage and the track, for supporting the printing plate on the non-emulsion side without the use of rollers, belts, bearings or air cushioning. The carriage includes one or more engagement mechanisms for engaging a bottom, non-emulsion side of the printing plate, and the track includes an air cylinder. The engagement mechanisms can be, for example, suctions cups which engage the plate by a vacuum, suction cups which engage the plate by pressure and adhesion, other adhesive devices, or a mechanical gripper for gripping the plate. The track or linear actuating system is preferably an air cylinder. Alternatively the linear actuating system could include a belt and pulleys, a chain and gears, or a threaded lead screw.

14 Claims, 7 Drawing Sheets

PRINTING PLATE CONVEYOR SYSTEM

BACKGROUND OF THE INVENTION

Imagesetters and platesetters are used to expose media that are used in offset printing systems. Imagesetters are typically used to expose the film that is then used to make the printing plates (also referred to as "plates") for the printing system. Platemaking systems include platesetters also known as platemakers for directly exposing the printing plates with a laser imaging head.

For example, printing plates are typically pre-cut, various-sized and coated with photosensitive or thermally-sensitive material layers, referred to as the emulsion. For large run applications, the plates are often fabricated from aluminum, although organic substrates, such as polyester or paper, are also available for smaller runs.

Computer-to-plate printing systems are used to render digitally stored print content onto these printing plates. In a platemaking system a computer system is typically used to drive an imaging engine of the platesetter. In a common implementation, the printing plate is fixed to the outside or inside of a drum or held on a flat bed and then scanned with a modulated laser source in a raster fashion.

The imaging engine selectively exposes the emulsion that is coated on the printing plates with the desired image. After this exposure, the printing plate is typically further processed in machines called processors so that, during the printing process, inks will selectively adhere to the printing plate's surface to transfer the ink to the print medium. Often the post-exposure plate processors include a developer stage for developing the printing plates. Sometimes intervening ovens are used to bake or harden the emulsion before development.

Platesetters are typically used in commercial, production environments. They are used in the manufacture of printing plates for newspapers, books, and magazines, for example. Once imaged and developed, the printing plates are mounted onto large offset printing presses for the printing run.

Since platemakers are used in these commercial environments, metrics, such as initial cost and total cost of ownership, are critical in differentiating between products of various manufacturers. In order to keep the cost to manufacture the machines low, reductions in component costs are often an objective in machine redesigns. Relative to total cost of ownership, machine up-time, average cycle time, and amount of operator intervention required during operation, are very important to the potential buyers of these machines. To decrease the amount of operator intervention in the operation of the platemakers, system manufacturers often provide automation for such jobs as transferring or moving the printing plates to a staging area, to the imaging engine, and from the imaging engine to a developer, stacker or other processing stage.

Often, the cost of the automation accessories are high due to the challenges associated with moving these sometimes very large printing plates without damage or contamination. Thus, it is often not clear from a purely economic standpoint, whether a given owner should purchase the various available automation accessories, because these accessories are expensive and difficult to weigh against the cost to employ operators over the course of the platesetter's lifetime to perform the functions that would otherwise be performed by the automation accessories.

As noted above, one specific area of automation concerns the movement of the printing plates throughout the platemaking system, for example, moving a printing plate from the imaging engine to a stacker, developer, chemical bath, rinser, baking or fixing unit.

In most platemaking systems, the printing plates when ejected from the imaging engine are simply placed on an unload table. An operator must then manually move the printing plates to another location such as a plate stack or plate processor. In contrast, an automated conveyor system receives a printing plate as it is ejected from the imaging engine and automatically moves the printing plate to another location or processor without operator intervention.

Printing plate conveyor systems can be very expensive to manufacture and maintain, typically having many moving parts such as rollers, belts, chains, gears and mechanical linkages. Further, these conveyor systems preferably should include features to change the direction of plate movement. Specifically, since the processor in many environments is located next to the platesetter in order to preserve floor space, the printing plate is consequently ejected from the platesetter along one axis, and must be initially drawn along that same axis by the conveyor, thereafter changing the direction of the movement of the printing plate by 90° to move the printing plate to the processor.

In one example, a printing plate conveyor system includes a conveyor with a series of belts and pulleys for receiving and transporting the printing plate as it is ejected from the imaging engine. Once the plate is completely ejected, a set of rollers extends upward between the pulley belts to pick the plate off of the belts and move the plate in an orthogonal direction to the direction from which the plate was initially ejected.

SUMMARY OF THE INVENTION

The present invention is directed towards a conveyor system for transporting a printing plate in a platemaking system, where the conveyor system includes: a carriage riding on a track and one or more low friction substantially horizontal planar support surfaces made of a high wear laminate, positioned above the carriage and the track, for supporting the printing plate on the non-emulsion side without the use of rollers, belts, bearings or air cushioning. The carriage includes one or more engagement mechanisms for engaging a bottom, non-emulsion side of the printing plate, said track comprising an air cylinder.

The engagement mechanisms can be, for example, suctions cups which engage the plate by a vacuum, suction cups which engage the plate by pressure and adhesion, other adhesive devices, or a mechanical gripper for gripping the plate.

The track or linear actuating system can be one or two-directional and can include, for example, an air cylinder, a belt and pulleys, a chain and gears, or a threaded lead screw.

In another embodiment the present invention is directed towards a method for transporting a printing plate in a platemaking system. The method includes the steps of: using an engagement mechanism to attach a bottom, non-emulsion side of the printing plate to a movable carriage positioned beneath the printing plate; moving the carriage with an air cylinder to drag, without the use of rollers, belts, bearings or an air cushion, the printing plate along the bottom, non-emulsion side along a low friction substantially horizontal planar high wear laminate support surface; and controlling the engagement mechanism, carriage and air cylinder with a programmable controller.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention.

DETAILED DESCRIPTION OF THE PREFERRED EMBODIMENTS

Figure 1:
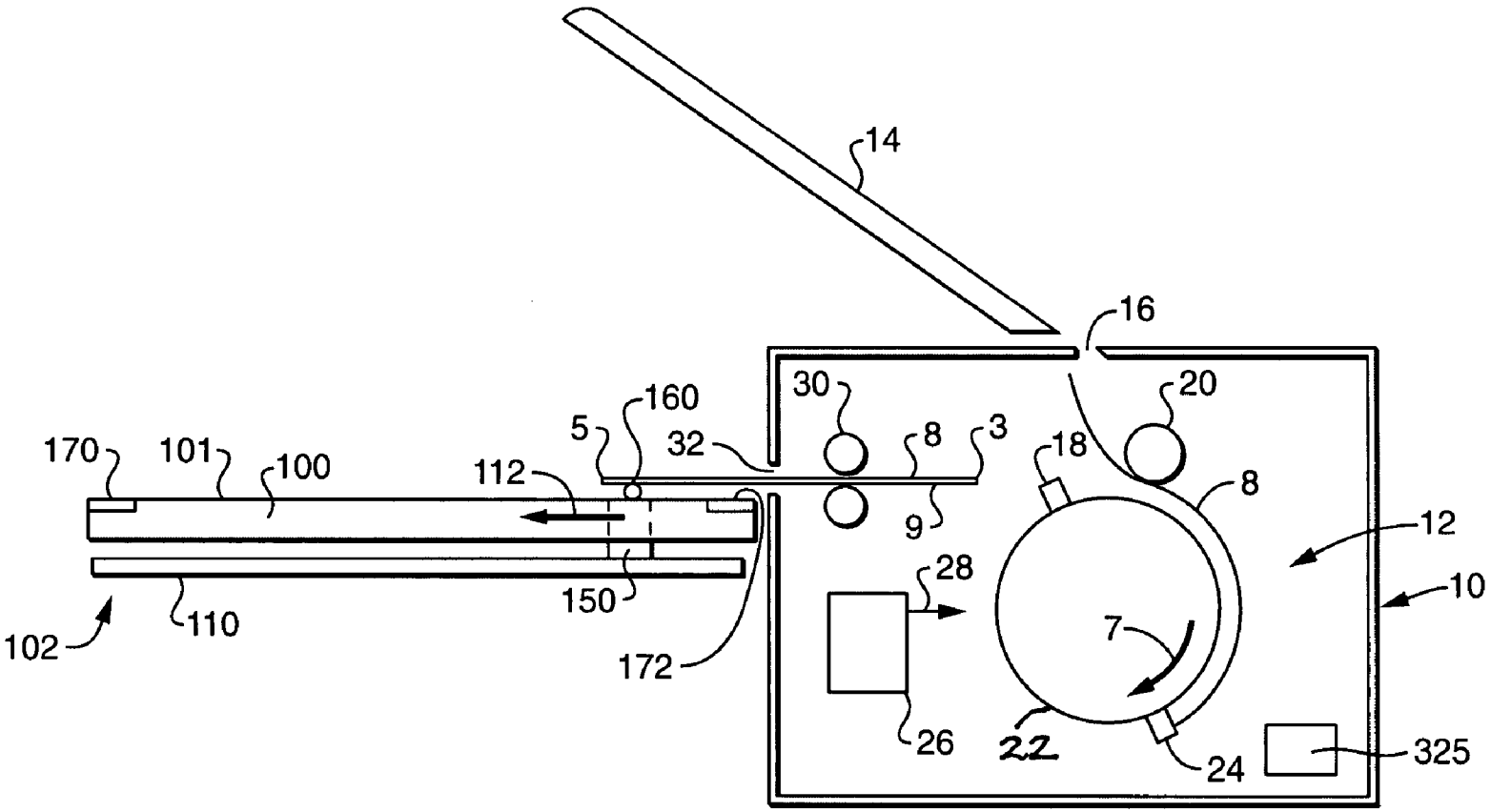
FIG. 1 is a side cross-sectional view of a platesetter, including a single-axis conveyor system for moving printing plates according to a preferred embodiment of the present invention.

FIG. 1 shows one embodiment of a platesetter or platemaking system having a conveyor system constructed according to the principles of the present invention for moving printing plates from the platesetter's imaging engine.

Printing plates are initially stored or queued onto a load table 14 for insertion into the imaging engine 12 of the platesetter 10 via a load port 16. In a preferred embodiment, the load table 14 includes a low friction surface that allows a printing plate 8 to be gravity fed through the load port 16 into the imaging engine 12. For example, in one specific embodiment, the load table 14 includes an "air hockey" style surface that creates an air bearing between the surface of the load table 14 and the underside of the plate 8 so that the plate 8 has an almost frictionless engagement between the load table 14, and thus slides easily through the load port 16 into the imaging engine 12.

Once in the imaging engine 12 of the platesetter 10, the leading edge 3 of the printing plate 8 is engaged by a leading edge clamp 24. This clamp 24 pins the leading edge 3 of the printing plate 8 to be held in a fixed position, relative to the external drum 22. An ironing roller 20 is used to urge the printing plate 8 against the outer periphery of the external drum 22, while the external drum 22 is advanced in the direction of arrow 7, until the trailing edge 5 of the printing plate 8 can be engaged by the trailing edge clamp 18, which holds the trailing edge 5 of the printing plate 8 against the outer surface of the external drum.

Next, during the imaging or exposure phase, an exposure system 26 generates a modulated light beam 28 that is scanned in a helical fashion over the printing plate 8. This allows for the selective exposure of the printing plate with the desired image.

Once completely exposed, the printing plate 8 is ejected from the imaging engine 12. In the illustrated embodiment, the trailing edge 5 of the printing plate 8 is first fed through ejection rollers 30 that feed the printing plate through an unload port 32.

According to the present invention, as the printing plate 8 is ejected through the unload port 32, it is received onto an unload table 100 having one or more low friction substantially horizontal planar support surface 101. The support surface 101 allows for low friction contact with the bottom non-emulsion side 9 of the printing plate 8, which prevents damage to the emulsion side of the printing plate 8. The low friction nature of the support surface 101 enables sliding of the printing plate 8 along the unload table 100. The support surface 101 is preferably Wilsonart® High Wear Laminate or Formica®. The support surface 101 is a high wear laminate having high wear surface papers which are impregnated with melamine resin pressed over core sheets impregnated with phenolic resin. These sheets then are bonded at pressures greater than 1000 pounds per square inch at temperatures approaching 300° F. (149° C.). Support surfaces of the same composition are preferably used throughout the conveyor system for low friction sliding or dragging of the printing plates.

According to the invention, a conveyor system 102 is used to drag or slide the printing plate 8 across the support surface 101 of the unload table 100. The fact that the printing plate 8 is dragged by the conveyor system 102 generally allows for the conveyor system and table 102 to be relatively inexpensive since a conveyor roller or belt system is not required. Furthermore, system reliability is improved and less maintenance is required due to fewer moving parts and mechanisms which are prone to malfunction and wear.

Specifically, in a preferred embodiment, the conveyor system 102 includes a track 110 and a carriage 150. The carriage 150 moves over the track 110 in the direction of arrow 112 to drag the printing plates 8 as they are ejected from the imaging engine 12 of the platesetter 10. In the preferred embodiment, an engagement mechanism is used to engage the printing plate 8, preferably by engaging the bottom non-emulsion side of the printing plate 8, so that the printing plate 8 moves with the carriage 150. The table 100 is preferably positioned above the carriage 150 and the track 110. Further, the table 100 is preferably provided with a home position detector 172 and an end travel position detector 170 for determining the home and end travel positions on the table of the printing plate, respectively. Other detectors can be placed incident to table 100, for example, for detecting different sized printing plates, centering an ejected printing plate and otherwise determining plate positioning as desired.

Figure 2:
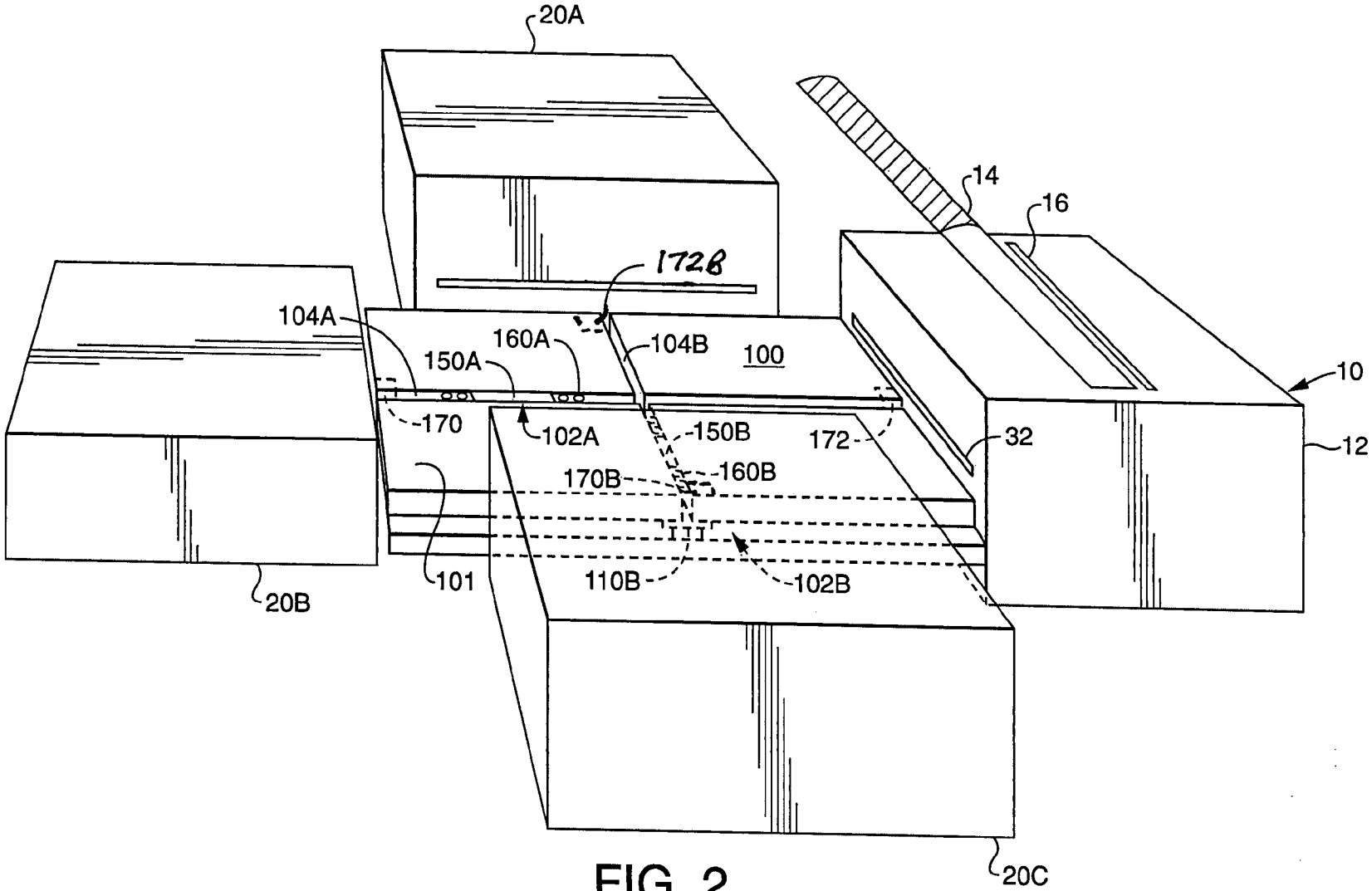
FIG. 2 is a schematic perspective view of a platemaker system including the platesetter of FIG. 1 which includes a two-axis plate moving conveyor system, according to another embodiment of the present invention.

FIG. 2 is a perspective view showing a dual axis embodiment of a plate conveyor system according to the present invention. Specifically, the unload table 100 is, in the illustrated example, divided into four quadrants by a first channel 104A that extends away from the platesetter 10 and a second channel 104B that extends orthogonally to the first channel 104A or in a lateral direction to the platesetter 10. The first axis conveyor 102A includes a first channel 104A that accommodates the movement of a first axis carriage 150A. As described previously, this first axis carriage 150A has its own plate engagement mechanism 160A. This carriage 150A rides on its own track or air cylinder not shown in this view.

The second axis conveyor 102B comprises a track or air cylinder 10B, a carriage 150B and its own plate engagement mechanism 160B. It rides in the orthogonal channel 104B. The first axis conveyor system 102A in combination with the second axis conveyor system 102B allow printing plates being drawn from the unload port 32 of the platesetter 10 to be passed on for further processing.

For example, in one embodiment, only the first axis conveyor 104A is used. This allows the printing plate 8 to be moved from the unload port 32 to a next station such as a stacker 20B. Alternatively, block 20B can be a work area for an operator that manually moves the printing plates as they are ejected from the platesetter 10.

The second axis conveyor 104B is provided to allow the printing plates 8 to be moved to either processor 20A or 20C that are located at an angle of 90 degrees, e.g. on a side or lateral to the platesetter 10. These processors 20A, 20C can be, for example, chemical developers, rinsing units or bake systems for hardening the emulsion of the printing plates 8.

Figure 3:
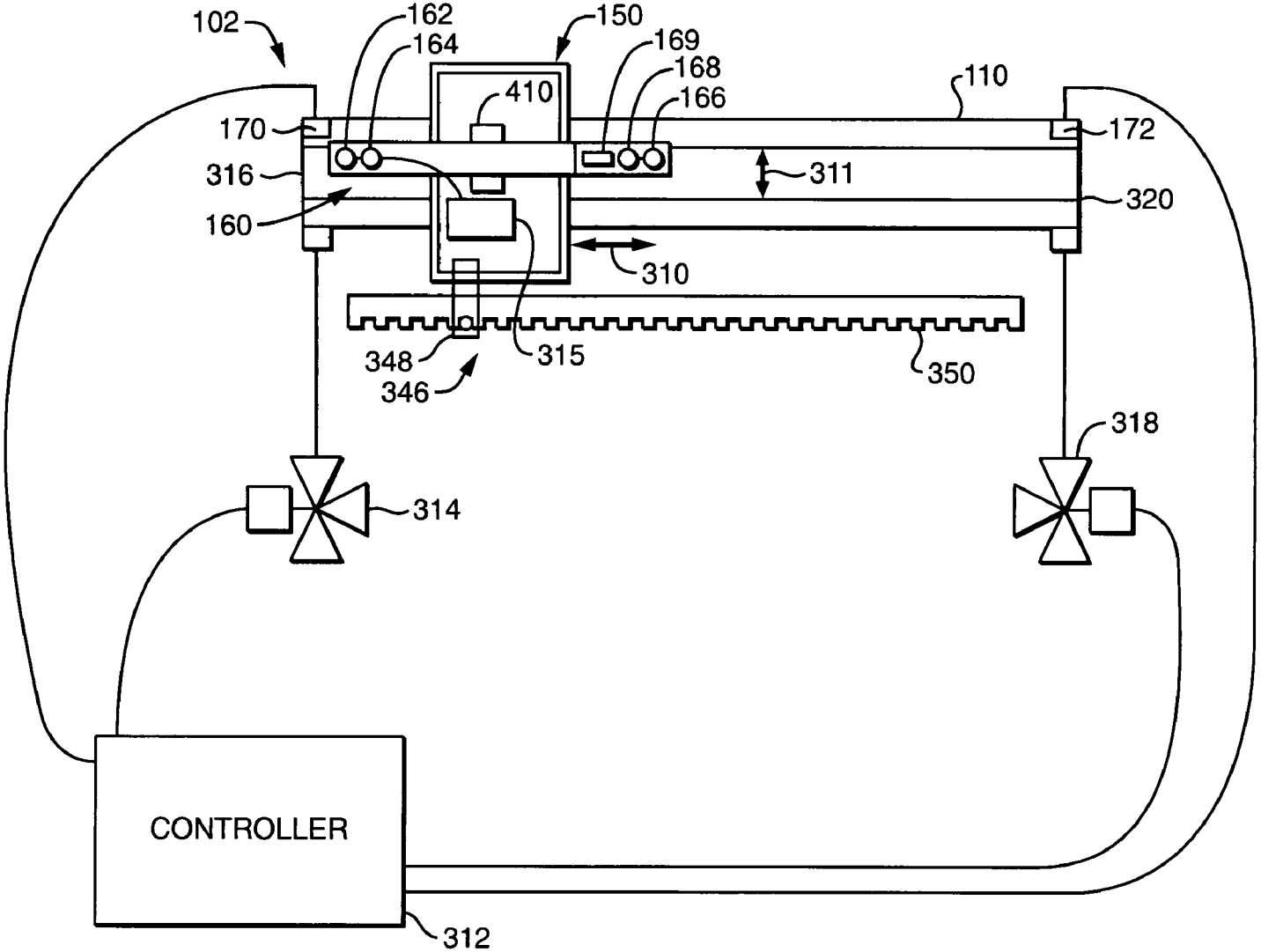
FIG. 3 is a schematic plan view of a portion of the conveyor system of FIG. 1.

FIG. 3 shows an exemplary embodiment of a plate conveyor system 102. Generally, the conveyor system includes one or more tracks 110. In the preferred embodiment, each track is a rodless air cylinder 110 controlled by programmable controller 312. The carriage 150 rides on the air cylinder 110 back and forth as illustrated by arrow 310.

In other embodiments, the track 110 can include a chain and gears, a belt and pulleys, or a piano screw. An important cost saving and reliability feature of the track 110 is that it acts as a linear actuating system in one or more directions. Also, the track 110 is physically narrow along the length of the first and second channels 104A, 104B so as to take up less space and require fewer working parts subject to maintenance and failure.

The carriage 150 includes an engagement mechanism 160 which, in the preferred embodiment, includes a suction cup extension arm 171 that moves vertically under the operation of the controller 312. By extending the suction cup extension arm 171 vertically, suction cups are brought into engagement with the bottom, non-emulsion side of the printing plate 8. Specifically, in the illustrated embodiment, the engagement mechanism 160 comprises four separate suction cups 162, 164, 166, 168. First and second suction cups 162, 164 are used to engage the printing plate 8 near its trailing edge 5. Suction cups 166, 168 engage the printing plate 8 nearer its leading edge 3. A vacuum generator 315 controlled by controller 312 is preferably located on the carriage 150 to provide for the generation of a vacuum for the operation of the suction cups 162, 164, 166, 168 so that the suction cups grip or engage the bottom, non-emulsion side of the printing plate 8 when vacuum is activated. The vacuum generator 315 is connected to the suction cups via hoses not shown in the figures.

Other known engagement mechanisms can be used in other embodiments such as adhesive and mechanical grippers. In some embodiments, the bottom or an edge of the printing plate 8 is engaged by the suction cups by a mechanical gripping mechanism without the use of a vacuum to move the plate along the support surface 101 of the table 100.

An extension arm plate sensor 169 is provided on the extension arm 171 to determine the presence and location of a printing plate 8 on the table 100 as the extension arm is moved along the table by detecting a reflective backing on the printing plate 8. Vacuum switch detector 516 detects that the plate has been engaged by the suction cups and is ready to be moved by the extension arm 171.

The air cylinder 110 is operated by a series of valves under the control of the controller 312. The controller 312 is programmed to automatically control all aspects and mechanisms of the plate conveyor system 102. A first valve 314 controls the provision of pressurized air to, or the venting of, a first end 316 of the air cylinder 110. A second valve 318 controls the provision of pressurized air to, or venting of, the second end 320 of the air cylinder 110. Specifically, an air compressor 325 provided as part of the platemaking system is used to provide the compressed air through the first and second valves 314, 318 for controlling the rodless air cylinder 110.

When the carriage 150 is moved to the left, for example, the controller 312 controls the second valve 318 to provide compressed air to the second end 320 of the air cylinder. This causes the air cylinder to move to the left, moving the carriage 150 to the left in the perspective of FIG. 3. Simultaneously, the first valve 314 is controlled to vent the air moving from the first end 316 of the air cylinder to the surrounding air.

Further, the controller 312 is able to hold the carriage 150 at a specific location by closing both the first valve 314 and the second valve 318. This prevents the air cylinder and the attached carriage 150 from any further movement.

In order to provide for the precision movement of the carriage 150 using the air cylinder 110, a series of absolute and relative carriage position sensors are used. Specifically, the home position sensor 172 is provided at the first end 316 of the air cylinder 110. The end travel sensor 170 is provided at the second end 320 of the air cylinder. These sensors provide information to the controller 312 so that the controller is able to detect the home or end travel positions of the printing plate 8. The dual axis embodiment of FIG. 2 illustrates a home position sensor 172 and an end travel sensor 170 for detecting home or travel positions of the first axis carriage 150A. Also shown is a home position sensor 172B and an end travel sensor 170B for detecting home or travel positions of the second axis carriage 150B.

The movement of the carriage 150 between the position sensors 172, 170 is provided by a relative position sensor 348. In one embodiment, the relative position sensor 348 is a tooth detector for measuring position along a tooth array 350. Specifically, the position sensor 348 is attached to the carriage 150 and rides adjacent to the tooth array 350. The sensor 348 functions to count the passing of the teeth along the tooth array 350. The sensor 348 can, for example, be an optical detector that detects the reflective metal that interrupts the transmission of an optical signal between an optical sensor and the detector. In this way, the controller 312 is able to count the progression of the tooth array 350 relative to the sensor 348, and thereby is able to detect movement of the carriage 150 between the home and end travel positions.

The extension arm 171 is controlled by controller 312 and moved vertically in a direction depicted by arrows 311 by an extension arm air cylinder 410. It moves the air cylinder vertically up or down to bring the suction cups 162, 164, 166, 168 of the engagement mechanism 160 into and out of engagement with the bottom non-emulsion side 9 of the printing plate 8.

Figure 4:
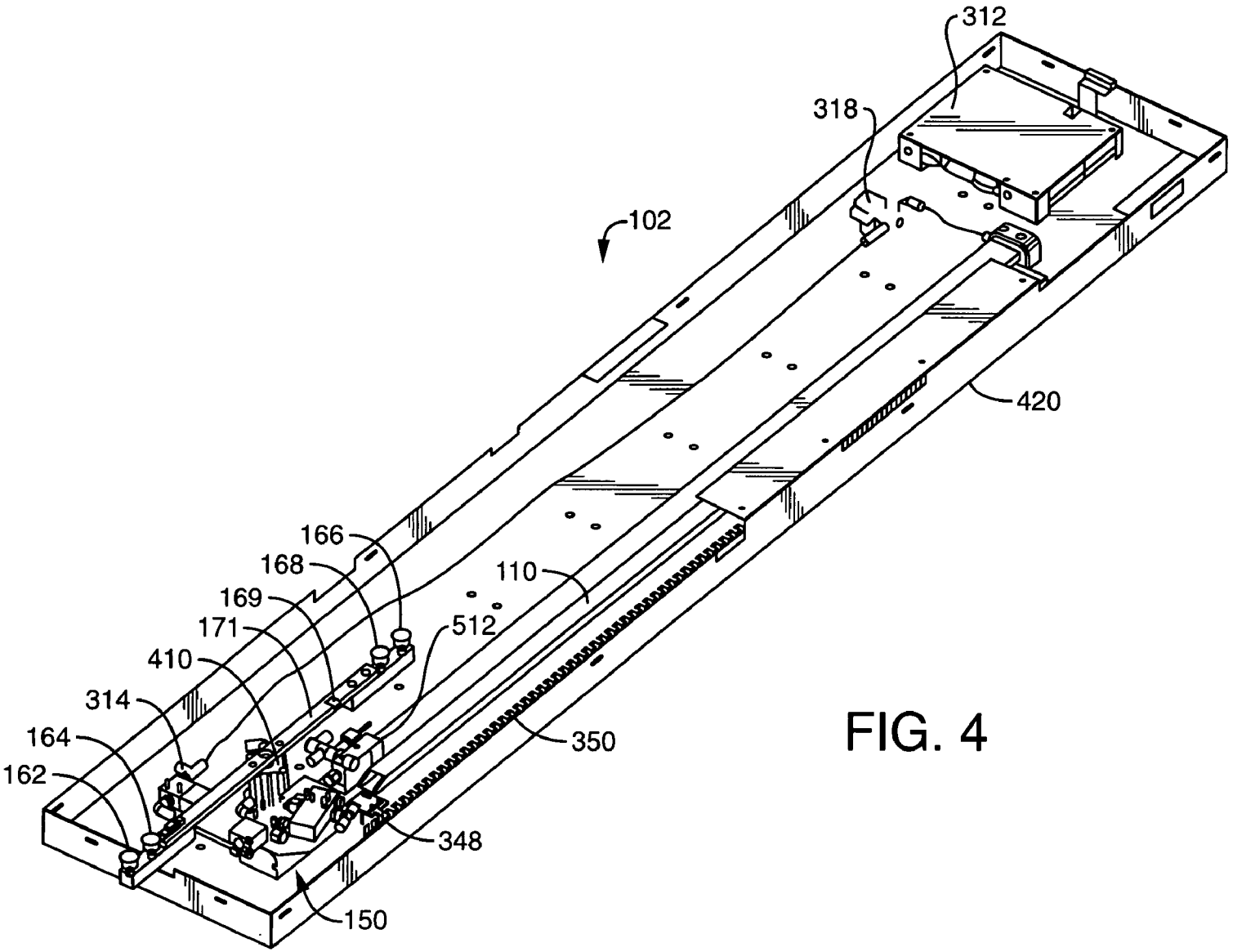
FIG. 4 is a perspective view of a portion of the conveyor system of FIG. 1.
Figure 5:
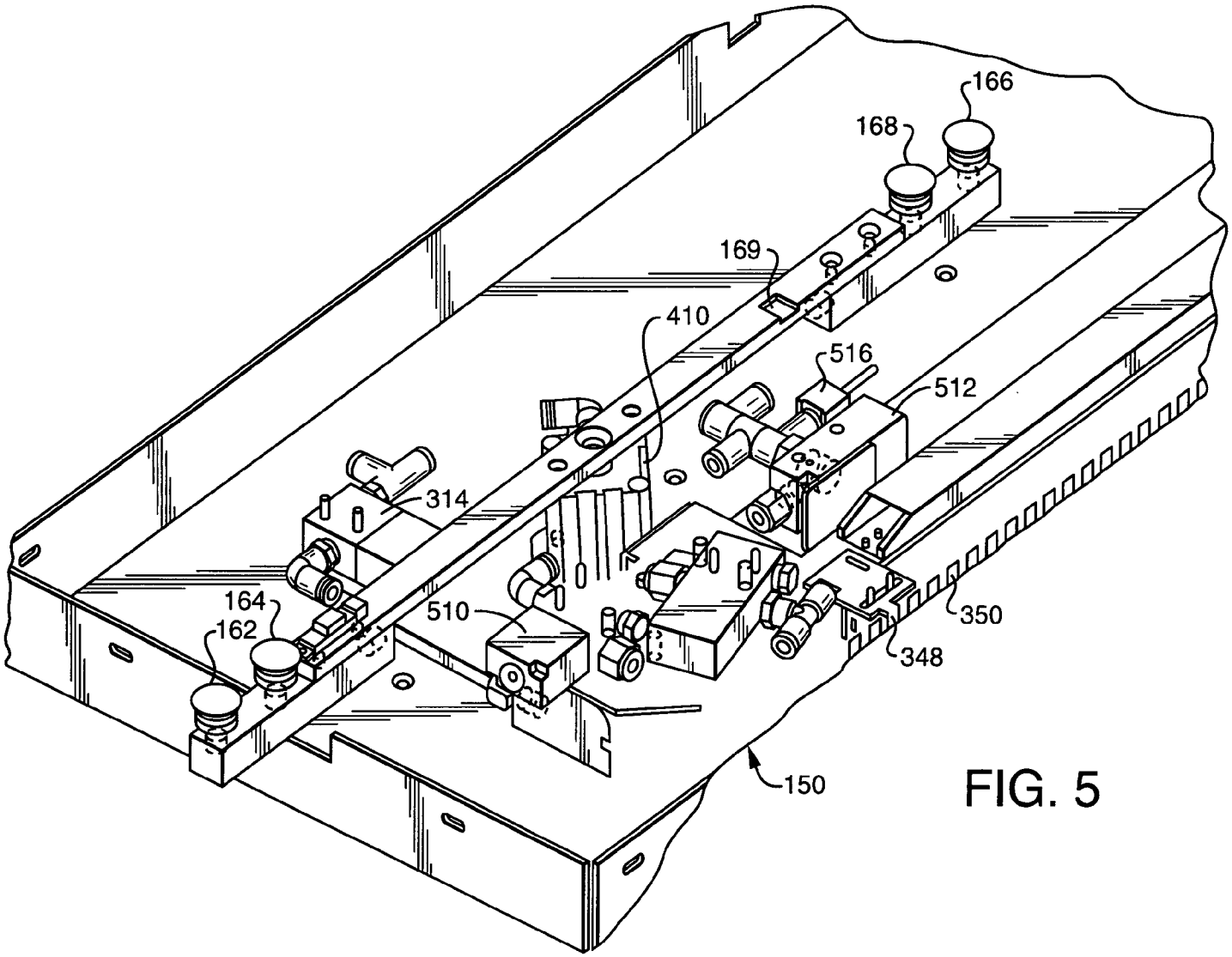
FIG. 5 is an enlarged perspective view of the carriage mechanism of the conveyor system of FIG. 4.

FIGS. 4 and 5 show one specific implementation of the conveyor system 102. FIG. 5 shows a close up view of the carriage 150. Specifically, the conveyor system 102 is provided with a tray-like frame 420. The track or air cylinder 110 is secured to the frame 420. The carriage 150 rides on the track 110 and supports the extension arm air cylinder 410. In the illustrated example, the tooth array 350 is oriented on the frame 420 so that the optical detector 348 can detect the individual teeth of the array 350 as the carriage 150 moves along the air cylinder 110. FIG. 5 further shows control valve 512 that is used to control the operation of the extension arm air cylinder 410, and control valve 510 that is used to control the vacuum generator 315.

Figure 6:
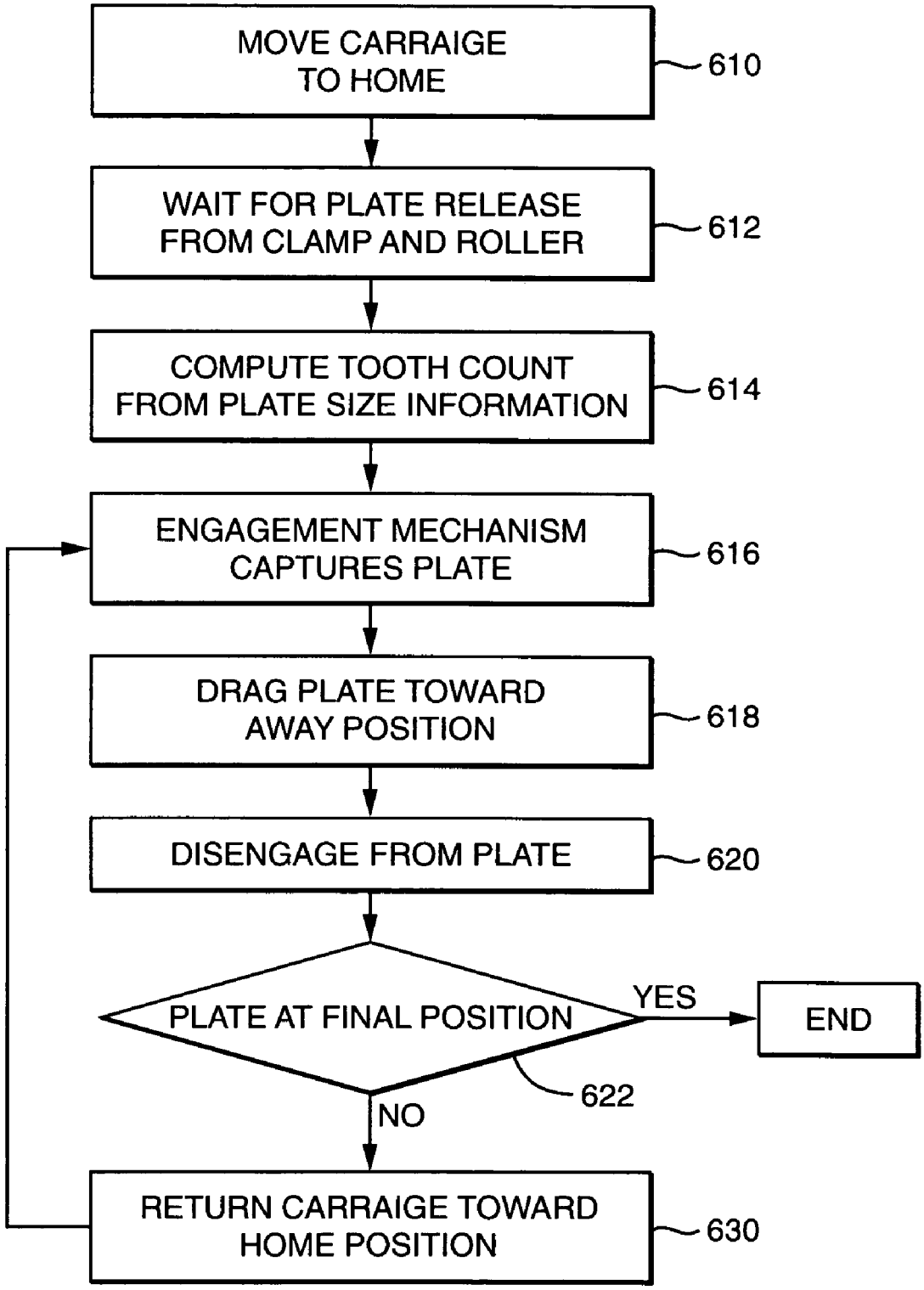
FIG. 6 is a flow diagram showing the steps of moving the printing plates in a conveyor system according to an embodiment of the inventive method.

FIG. 6 is a flow diagram illustrating the operation of a one dimensional conveyor system for moving printing plates in a platemaking system. Specifically, the air cylinder 110 first moves the carriage 150 to the home position opposite the first absolute carriage position sensor 340 in step 610. It then waits for the printing plate 8 to be released from the leading edge clamp and feed rollers 30 in the platesetter 10 in step 612. Then, in step 614, the plate size is used to compute the number of teeth in the tooth array 350 that the carriage 150 must move to end up in a desired location on the support surface 101 of the table 100. In step 616, the printing plate is captured by the engagement mechanism 160 of the conveyor system 102. Specifically, the extension arm air cylinder 410 is activated to raise the extension arm 171. The vacuum generator 315 is simultaneously activated so that the appropriate one or more of the suction cups 162, 164, 166, 168 engage the bottom non-emulsion surface of the printing plate 8.

In one implementation, the generated vacuum is monitored by a vacuum level detector 516 to ensure that the suction cups 162, 164, 168, 166 have made a good contact with the bottom of the printing plate 8. Specifically, if the vacuum generator 315 is not able to maintain a predetermined level of vacuum, then the controller 312 will receive a signal from the vacuum level detector 516 and the system will go into an error status indicating that the bottom non-emulsion side of the printing plate 8 was not properly engaged.

Next, with the plate engaged, the carriage 150 is moved a predetermined distance corresponding to a computed number of teeth of the tooth array 350 toward the second absolute carriage position sensor 342 in step 618. Once at the desired location, the plate is released by de-energizing the vacuum generator 315 and lowering the extension arm 171 by controlling the extension arm air cylinder 410 in step 620.

At this time, it is determined in step 622 whether the edge of the printing plate was detected by edge sensor 170. If the trailing edge 5 of the printing plate 8 is not yet at the plate edge sensor 170, then the vacuum is de-activated and the plate is released by the suction cups while the carriage 150 is moved toward the first absolute carriage position sensor 340 in step 630. Then the printing plate is re-engaged in step 616 and again, moved toward the second absolute carriage position sensor 342 in step 618. Depending on the plate size, the printing plate can be moved a calculated distance. In other cases it is moved based upon detection of the trailing edge 5 by the first edge detector 170. In one embodiment, the printing plate is passed to a stacker. Here, a portion of the plate is actually moved off of the table 100 to engage with the stacker, which then takes up the plate and removes it from the unload table 100.

Figure 7:
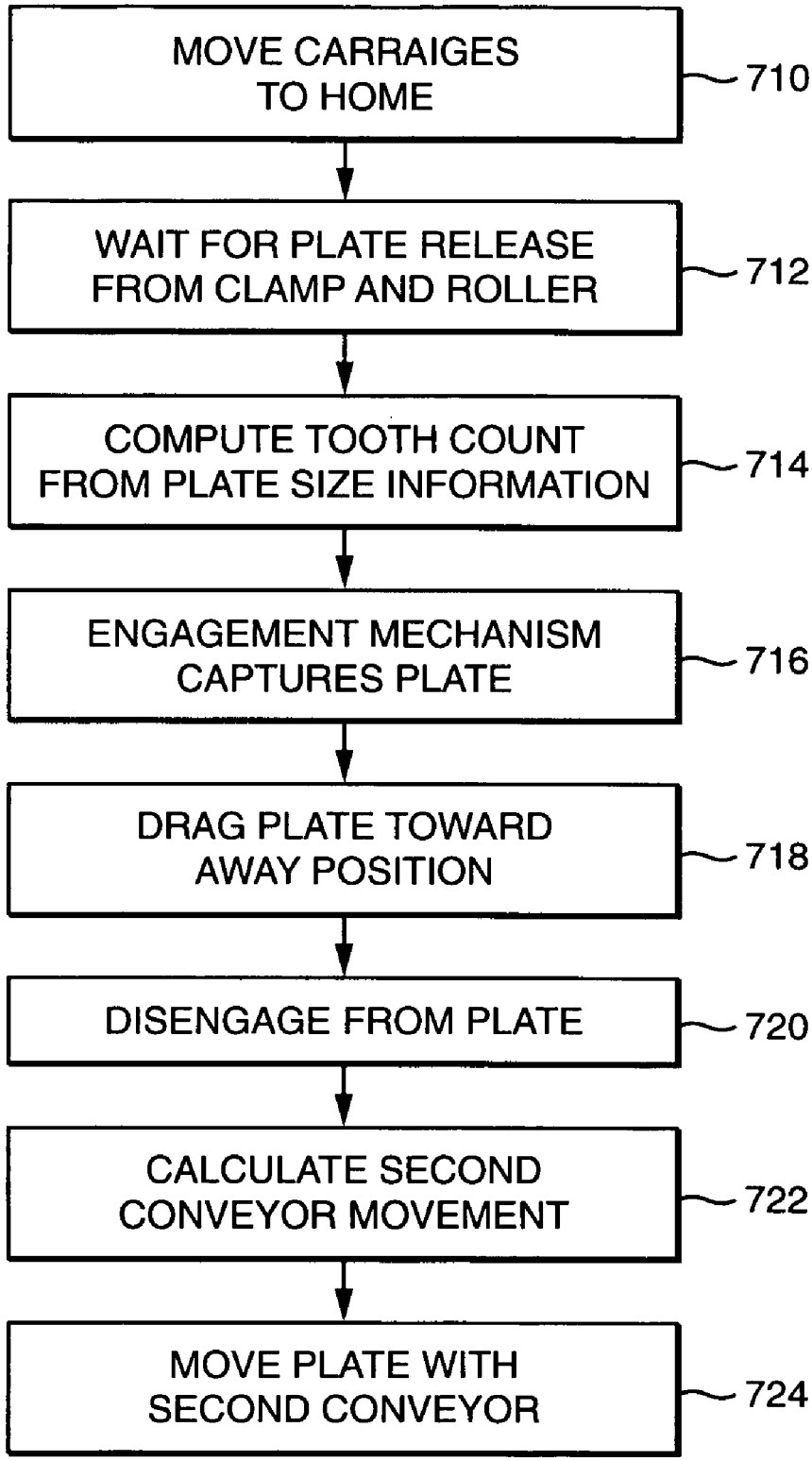
FIG. 7 is a flow diagram showing the steps of moving the printing plates according to another embodiment of the inventive method.

FIG. 7 is a flow diagram illustrating the operation of a two-dimensional plate conveyor. Specifically, the air cylinders first move the carriages 150A and 150B to the home positions opposite their first absolute carriage position sensors 340 in step 710. They then wait for the printing plate 8 to be released from the leading edge clamp and feed rollers 30 in the platesetter 10 in step 712. In some systems, no feed rollers are needed to eject the plate from the platesetter. Then, in step 714, the plate size is used to compute the number of teeth in the tooth array 350 that the carriage 150A must move in order to center the printing plate 8 on the table 100 and over the track of the second conveyor 102B. In step 716, the printing plate is captured by the engagement mechanism 160A of the conveyor system 102A.

Next, with the printing plate engaged, the carriage 150A is moved to center the printing plate, moving in the direction of the second absolute carriage position sensor 342 in step 718. Once at the desired location, the printing plate 8 is released by de-energizing the vacuum generator 315 and lowering the extension arm 171 by controlling the extension arm air cylinder 410 in step 720.

At this time, the tooth count needed for the second conveyor 102B to move the printing plate 8 to the processor 20 is calculated in step 722. The second conveyor 102B then engages the printing plate 8 and slides it along the low friction high wear laminate support surface 101 to the processor in step 724. If the printing plate is not at the processor, the second conveyor 102B repeats the dragging operation by disengaging from the plate, moving back a predetermined distance, then re-engaging and dragging the plate.

While this invention has been particularly shown and described with references to preferred embodiments thereof, it will be understood by those skilled in the art that various changes in form and details may be made therein without departing from the scope of the invention encompassed by the appended claims.

What is claimed is:

1. A conveyor system for transporting a printing plate in a platemaking system, the conveyor system comprising:

a carriage riding on a track, said carriage comprising one or more engagement mechanisms for engaging a bottom, non-emulsion side of the printing plate, said track comprising an air cylinder; and one or more low friction substantially horizontal planar support surfaces comprising a high wear laminate, positioned above the carriage and the track, for supporting the printing plate on the non-emulsion side without the use of rollers, belts, bearings or air cushioning.

2. The conveyor system of claim 1 wherein said air cylinder is rodless.

3. The conveyor system of claim 1 wherein the engagement mechanism comprises suction cups to engage the bottom, non-emulsion-side of said printing plate when a vacuum is provided by a vacuum generator through controllable valves to said suction cups.

4. The conveyor system of claim 3 further comprising a controller to control said vacuum generator, said carriage and said air cylinder to move said printing plate along said one or more support surfaces.

5. The conveyor system of claim 4 further comprising one or more detectors to provide signals pertaining to positioning of said printing plate on said one or more support surfaces, wherein said controller is programmed to start and stop movement of the air cylinder in response to said signals.

6. The conveyor system of claim 1 wherein said high wear laminate comprises surface papers impregnated with melamine resin.

7. The conveyor system of claim 6 wherein said surface papers are pressed over core sheets impregnated with phenolic resin.

8. The conveyor system of claim 7 wherein said surface papers and core sheets are bonded at pressures greater than about 1000 pounds per square inch.

9. The conveyor system of claim 8 wherein said surface papers and core sheets are bonded at temperatures approaching 300 degrees Fahrenheit.

10. A method for transporting a printing plate in a platemaking system, the method comprising the steps of:

using an engagement mechanism to attach a bottom, non-emulsion side of the printing plate to a movable carriage positioned beneath the printing plate;

moving the carriage with an air cylinder to drag, without the use of rollers, belts, bearings or an air cushion, the printing plate along the bottom, non-emulsion side along a low friction substantially horizontal planar high wear laminate support surface; and controlling the engagement mechanism, carriage and air cylinder with a programmable controller.

11. The method of claim 10 wherein said air cylinder is rodless.

12. The method of claim 10, the controlling step further comprising starting and stopping the air cylinder at predetermined intervals along a length of the air cylinder.

13. The method of claim 10 wherein said support surface comprises surface papers impregnated with melamine resin, said surface papers are pressed over core sheets impregnated with phenolic resin, said surface papers are bonded at pressures greater than about 1000 pounds per square inch, and said surface papers and core sheets are bonded at temperatures approaching 300 degrees Fahrenheit.

14. A conveyor system for transporting a printing plate in a platemaking system, the conveyor system comprising:

a carriage riding on a track, said carriage comprising one or more engagement mechanisms for engaging a bottom, non-emulsion side of the printing plate, said track comprising a linear actuating system; and one or more low friction substantially horizontal planar support surfaces comprising a high wear laminate, positioned above the carriage and the track, for supporting the printing plate on the non-emulsion side without the use of rollers, belts, bearings or air cushioning.

* * * * *